US006853371B2

(12) United States Patent
Miyajima et al.

(10) Patent No.: US 6,853,371 B2
(45) Date of Patent: Feb. 8, 2005

(54) DISPLAY DEVICE

(75) Inventors: Yasushi Miyajima, Gifu (JP); Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 390 days.

(21) Appl. No.: 09/953,237

(22) Filed: Sep. 17, 2001

(65) Prior Publication Data

US 2002/0036612 A1 Mar. 28, 2002

(30) Foreign Application Priority Data

Sep. 8, 2000 (JP) ..... 2000-282172
Sep. 18, 2000 (JP) ..... 2000-282174

(51) Int. Cl.[7] ..... G09G 5/00

(52) U.S. Cl. ..... 345/206; 345/205; 345/90; 345/92

(58) Field of Search ..... 345/90, 92, 205, 345/206, 204, 55, 87, 98

(56) References Cited

U.S. PATENT DOCUMENTS

RE35,275 E * 6/1996 Okubo et al. ..... 349/42
5,712,652 A 1/1998 Sato et al.
5,784,039 A * 7/1998 Yasui et al. ..... 345/89
5,790,090 A 8/1998 Libsch et al.
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,181,311 B1 * 1/2001 Hashimoto ..... 345/98
6,636,194 B2 * 10/2003 Ishii ..... 345/98

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 08-194205 | 7/1996 |
| JP | 09-236823 | 9/1997 |
| JP | 2001-242819 | 9/2001 |

* cited by examiner

*Primary Examiner*—Richard Hjerpe
*Assistant Examiner*—Peter Prizio
(74) *Attorney, Agent, or Firm*—Morrison & Foerster LLP

(57) ABSTRACT

Within one pixel element 200, two display circuits corresponding to the analog display mode and the digital display mode are disposed such that they are adjacent to each other. One of these two display circuits can be selected through the circuit selection circuits 40 or 43. Since the high voltage power line 150 of the retaining circuit 110, which is used under the digital display mode, also performs as the signal selection line 88, it is possible to have the high density integration of the pixel element 200. Also, the bias voltage Vsc supplied through the selection storage capacitor line 81 is same as the signal A. Therefore, the storage capacitor line 81 is connected to the drain of the TFT 122 of the signal selection circuit 120 so that the signal line 82 for supplying the signal A can be omitted. Thus, the high-density integration of the pixel element 200 can be achieved.

9 Claims, 8 Drawing Sheets

DISPLAY DEVICE

FIELD OF THE INVENTION

This invention relates to a display device and its driving method, especially to a display device of low-energy consumption which is incorporated into a portable communication and computing device.

BACKGROUND OF THE INVENTION

There has been a great demand in the market for portable communication and computing devices such as a portable TV and cellular phone. All these devices need a small, light-weight and low-power consumption display device, and development efforts have been made accordingly.

FIG. 8 shows a circuit diagram corresponding to a single pixel element of a conventional liquid crystal display device. A gate signal line 51 and a drain signal line 61 are placed on an insulating substrate (not shown in the figure) perpendicular to each other. A TFT 65 connected to the two signal lines 51, 61 is formed near the crossing of the two signal lines 51, 61. The source 11*s* of the TFT 65 is connected to a pixel electrode 80 of the liquid crystal 21.

A storage capacitor element 85 holds the voltage of the pixel electrode 80 during one field period. A terminal 86, which is one of the terminals of the storage capacitor element 85, is connected to the source 11*s* of the TFT 65, and the other terminal 87 is provided with a voltage common among all the pixel elements. When a scanning signal is applied to the gate signal line 51, the TFT 65 turns to an on-state. Accordingly, an analog image signal from the drain signal line 61 is applied to the pixel electrode 80, and the liquid crystal 21 through the pixel electrode 80, and the storage capacitor element 85 holds the voltage. The voltage of the image signal is applied to the liquid crystal 21 through the pixel electrode 80, and the liquid crystal 21 aligns in response to the applied voltage for providing a liquid crystal display image. This configuration is capable of showing both moving images and still images. There is a need for the display to show both a moving image and a still image within a single display. One such example is to show a still image of a battery within area in a moving image of a cellular phone display to show the remaining amount of the battery power.

However, the configuration shown in FIG. 8 requires a continuous rewriting of each pixel element with the same image signal at each scanning in order to provide a still image. This is basically to show a still-like image in a moving image mode, and the scanning signal needs to activate the TFT 65 at each scanning. Accordingly, it is necessary to operate a driver circuit which generates a drive signal for the scanning signals and the image signals, and an external LSI which generates various signals for controlling the timing of the drive circuit, resulting in a consumption of a significant amount of electric power. This is a considerable drawback when such a configuration is used in a cellular phone device, which has only a limited power source. That is, the time a user can use the telephone under one battery charge is considerably short.

Japanese Laid-Open Patent Publication No. Hei 8-194205 discloses another configuration for display device suited for portable applications. This display device has a static memory for each of the pixel elements, as shown in FIG. 9. A static memory, in which two inverters INV1 and INV2 are positively fed back to each other, holds the image signal for reducing the power consumption. In this configuration, a switching element 24 controls the resistance between a reference line and a pixel electrode 80 in response to the divalent digital image signal held by the static memory in order to adjust the biasing of the liquid crystal 21. The common electrode, on the other hand, receives an AC signal Vcom. Ideally, this configuration does not need refreshing the memory when the image stays still for a period of time.

As described above, the conventional liquid crystal display device is suitable for displaying a full color moving picture generated by analog signals. On the other hand, the display device equipped with a static memory for holding digital image signal is suitable for displaying a still image of the shallow depth and reducing the consumption of the electric power.

However, since the two types of the liquid crystal display device need different types of image signal source respectively, there have been no liquid crystal display device capable of showing both a full color moving image and a still image of low energy consumption in a single display.

SUMMARY OF THE INVENTION

This invention is directed to a display device (for example, one liquid crystal display panel) enabling both a full color moving picture display and a still picture display of low energy consumption in a single display device. Also, this invention is directed to the high-density integration of the pixel elements in such display device. The gist of this invention will be stated below.

According to the first configuration of this invention, there is provided a display device having a plurality of gate signal lines disposed in a predetermined direction on a substrate, a plurality of drain signal lines disposed in a direction perpendicular to the predetermined direction, a plurality of pixel elements which are disposed as a matrix, activated by the scanning signal fed through the gate signal line and provided with the image signal fed through the drain signal line, a pixel electrode provided within each of the pixel elements, a first display circuit which is disposed for each of the pixel elements and successively provides the pixel elements with the image signals successively inputted, a second display circuit which is disposed for each of the pixel elements, includes a retaining circuit holding the image signal and provides the pixel electrode with an voltage corresponding to the image signal retained by the retaining circuit, and a circuit selection circuit for selecting one of the first and second display circuit in response to a circuit selection signal for each of the pixel element. The circuit selection signal is supplied to the circuit selection circuit through an electric power line which is otherwise used for supplying a power voltage to the retaining circuit.

In this configuration, the electric power line, through which a power voltage is supplied to the retaining circuit, is also used as a circuit selection signal line. Sine the circuit selection signal line between the pixel elements adjacent to each other can also be omitted, the integration of the pixel element can be improved.

There is also provided in the first configuration, a retaining circuit comprising two inverter circuits which are positively fed back to each other, each of the inverter circuits being provided with a high voltage power line and a low voltage power line. The high voltage power line feeds the circuit selection signal to the circuit selection circuit.

By this, the high voltage power line provided for the inverter circuit is also used as circuit selection signal line, resulting in the reduction of one signal line.

There is also provided in the first configuration, the circuit selection circuit comprising a first switching element for selecting the first display circuit and a second switching circuit for selecting the second display circuit. The first and second switching elements complimentarily performs a switching operation in response to the circuit selection signal supplied through the high voltage power line.

By this, the circuit selection by the circuit selection circuit can be carried out by using the high voltage power line provided for the retaining circuit.

According to the second configuration of this invention, there is provided a display device having a plurality of gate signal lines disposed in a predetermined direction on a substrate, a plurality of drain signal lines disposed in a direction perpendicular to the predetermined direction, a plurality of pixel elements which are disposed as a matrix, activated by the scanning signal fed through the gate signal line and provided with the image signal fed through the drain signal line, a first display circuit which has a storage capacitor element for holding an analog image fed through the drain signal line in response to a signal fed through the gate signal line and supplies the signal held by the storage capacitor element to a pixel electrode, a second display circuit which is disposed near the first display circuit, includes a retaining circuit holding a digital image signal fed through the drain signal line in response to the signal fed through the gate signal line and a signal selection circuit for selecting one of the signals to the pixel electrode, and a circuit selection circuit for selecting one of the first and second display circuits in response to a circuit selection signal. One of the first and second signal lines performs as a storage capacitor line for biasing an electrode of the storage capacitor element. By this, one of the first and second signal lines can be omitted, resulting in the reduction of one signal line. Since the wiring requires less space, the size reduction of the pixel element can be achieved.

Also, in the second configuration, the signal fed to the storage capacitor line and the signal fed to the common electrode of the pixel electrode are the same signal. Therefore, the signal fed through, for example, the first signal line is the same signal as the signal fed to the storage capacitor line and to the common electrode. Since the display device operates correctly under this configuration, it is possible to reduce the number of the signal lines efficiently.

DESCRIPTION OF THE INVENTION

Figure 1:
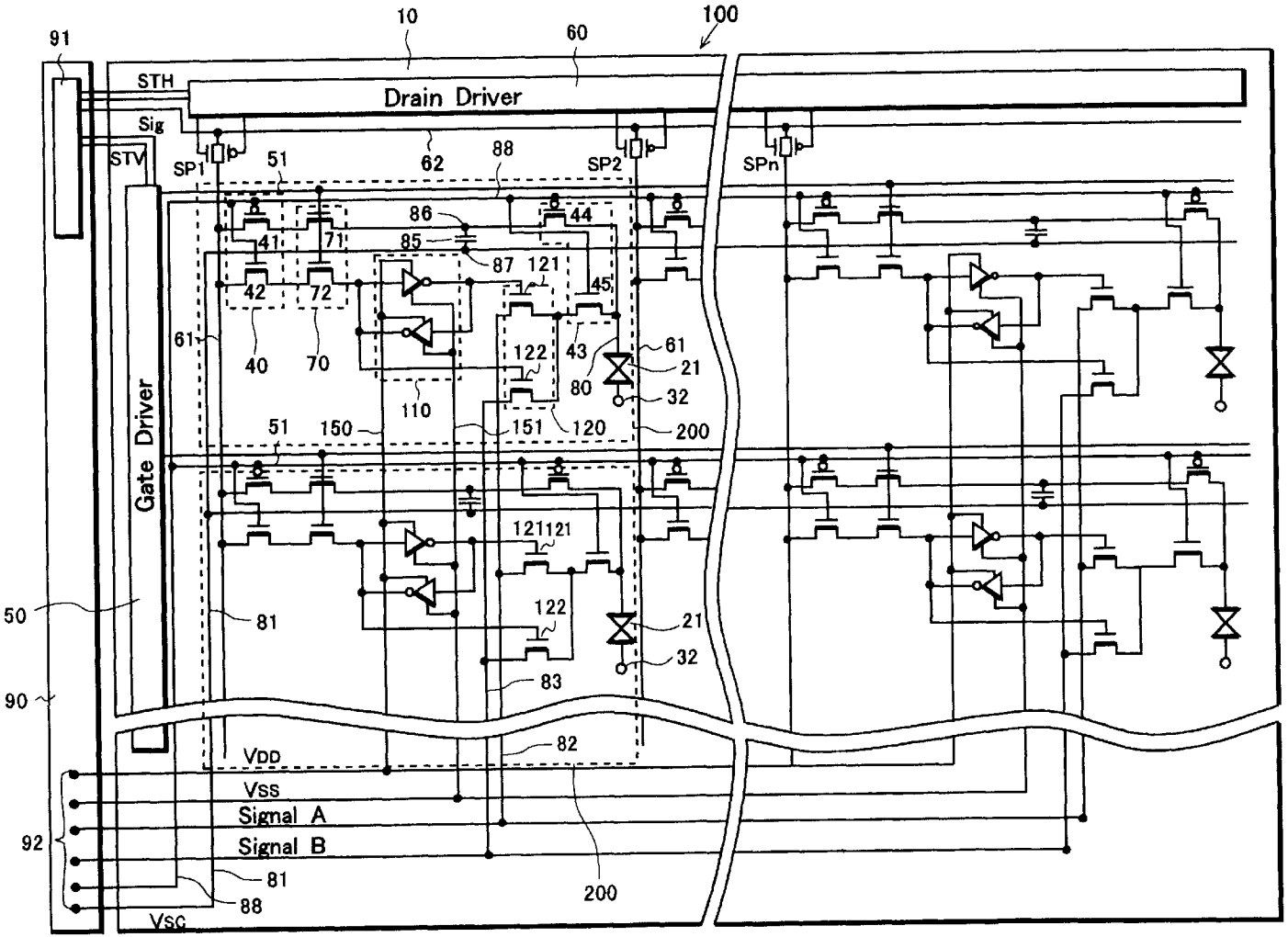
FIG. 1 is a circuit diagram of a liquid crystal display device to which this invention is applied.

Next, the display device relating to the first embodiment of this invention will be explained. FIG. 1 shows a circuit diagram of a liquid crystal device to which the first embodiment of the display device of this invention is applied.

On an insulating substrate 10, a plurality of gate signal lines 51 connected to a gate driver 50 for providing scanning signals are aligned in one direction. A plurality of drain signal lines 61 are aligned in the direction perpendicular to the direction of the gate signal lines 51.

Sampling transistors SP1, SP2, . . . , SPn turn on in response to the timing of the sampling pulse fed from the drain driver 60, and connect the drain signal lines 61 to the data signal lines 62 carrying the data signal, which is the digital image signal or the analog image signal.

The liquid crystal display panel 100 consists of a plurality of pixel elements 200 provided in a matrix configuration. These pixel elements 200 are selected by the scanning signal fed from the gate signal line 51 and receive the data signal fed from the drain signal line 61.

The detail of the configuration of the pixel element 200 will be explained below. A circuit selection circuit 40 having a P-channel TFT 41 and a N-channel TFT 42 is placed near the crossing of the gate signal line 51 and the drain signal line 61. The drains of TFTs 41, 42 are connected to the drain signal line 61 and the gates of the two TFTs are connected to the circuit selection signal line 88. One of the two TFTs 41, 42 turns on in response to a selection signal fed from the circuit selection signal line 88. The circuit selection circuit 43 comprising a P-channel TFT 44 and a N-channel TFT 45 is provided to cooperate with the circuit selection circuit 40.

A pair of the two circuit selection circuits 40, 43 enables the switching between the analog image display (full color moving image) and the digital image display (still image and low energy consumption). A pixel element selection circuit 70 having a N-channel TFT 71 and a N-channel TFT 72 is placed next to the circuit selection circuit 40. The TFTs 71, 72 are connected to the TFTs 41, 42 of the circuit selection circuit 40 in series, and both gates of the TFTs 71, 72 are connected to the gate signal line 51. Both of the TFTs 71, 72 turn on at the same time in response to the scanning signal fed from the gate signal line 51.

A storage capacitor element 85 holds the analog image signal in the analog mode. An electrode 86, one of the electrodes of the storage capacitor element 85, is connected to the source 71*s* of the TFT 71. Another electrode 87 is connected to a common storage capacitor line 88 carrying a bias voltage Vcs. In the analog mode, when the analog image signal is applied to the liquid crystal 21 after the opening of the gate of the TFT 71, the voltage of the applied signal is reduced even during a one field period, resulting in a loss of the homogeneity of the displayed image. The storage capacitor element 85 maintains the applied voltage at the initial level during one field period for eliminating the problem above.

A P-channel TFT 44 of the circuit selection circuit 43 is placed between the storage capacitor element 85 and the liquid crystal 21, and turns on and off in synchronization with the switching of the TFT 41 of the circuit selection circuit 40.

A retaining circuit 110 and a signal selection circuit 120 are placed between the TFT 72 of the pixel element selection circuit 70 and the pixel electrode 80 of the liquid crystal 21. The retaining circuit 110 has two inverter circuits, which are positively fed back to each other, and forms a static memory of digital divalent. Here, it is preferable to use CMOS type inverter circuit for the two inverter circuits in order to reduce the consumption of the electric power.

The signal selection circuit 120 has two N-channel TFTs 121, 122, and selects a signal in response to the signal fed from the retaining circuit 110. Since two complementary output signals from the retaining circuit 110 are applied to the gates of the two TFTs 121, 122, respectively, only one of the two TFTs 121, 122 turns on at a time.

The AC drive signal (signal B) is selected when the TFT 122 turns on, and the common electrode signal Vcom (signal A) is selected when the TFT 121 turns on. The selected signal is then applied to the pixel electrode 80 of the liquid crystal 21 through the TFT 45 of the circuit selection circuit 43. Here, the common electrode 32 of the liquid crystal 21 is provided with the common electrode signal Vcom (signal A).

In summary, there is provided the circuit (the first display circuit) comprising the pixel element selection element TFT 71 and the storage capacitor element 85 for holding analog image signal, and the circuit (the second display circuit) comprising the pixel element selection element TFT 72, the retaining circuit 110 for holding divalent digital image signal, and the signal selection circuit 120 in single pixel element 200. There is also provided the circuit selection circuits 40, 43 for selecting the circuit.

The liquid crystal display panel 100 has peripheral circuit as well. A panel drive LSI 91 is mounted on an external circuit board 90 fitted to the insulating substrate 10 of the liquid crystal panel 100, and sends the vertical start signal STV and the horizontal start signal STH to the gate driver 50 and the drain driver 60, respectively. The panel drive LSI also feeds the image signal to the data line 62.

Figure 2:
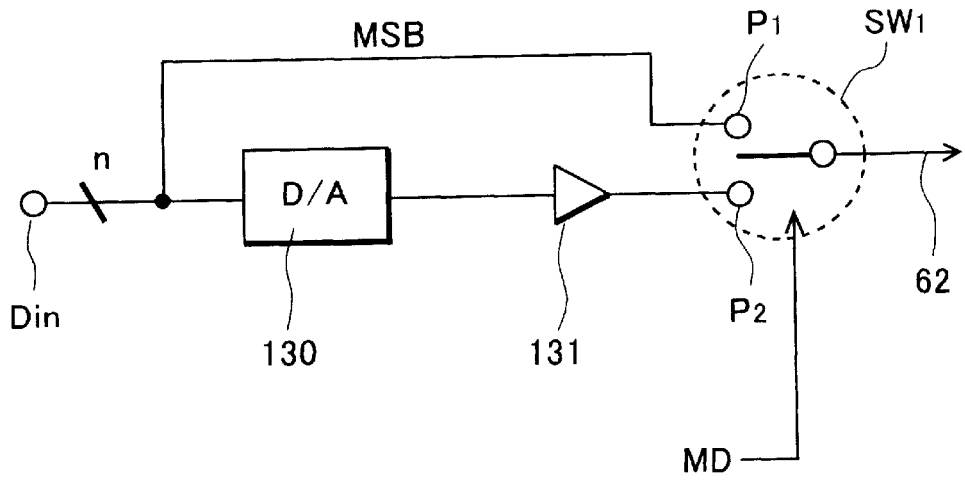
FIG. 2 is a circuit diagram of the switching circuit for the image signal of the first embodiment of this invention.

FIG. 2 is a circuit diagram of the switching circuit of the image signal. When the switch SW1 is connected to the terminal P2 side, the digital image signal with a n-bit is inputted from the input terminal Din, and then fed to the data line 62 after being converted to an analog image signal by a DA converter 130. On the other hand, when switch SW1 is changed to the terminal P1 side, the highest bit of the n-bit digital image signal is outputted to the data line 62. The change of the switch SW1 is done according to the mode switching signal MD, which controls the switching between the analog latch display mode and the digital latch display mode for reducing the consumption of the electric power.

Figure 3:
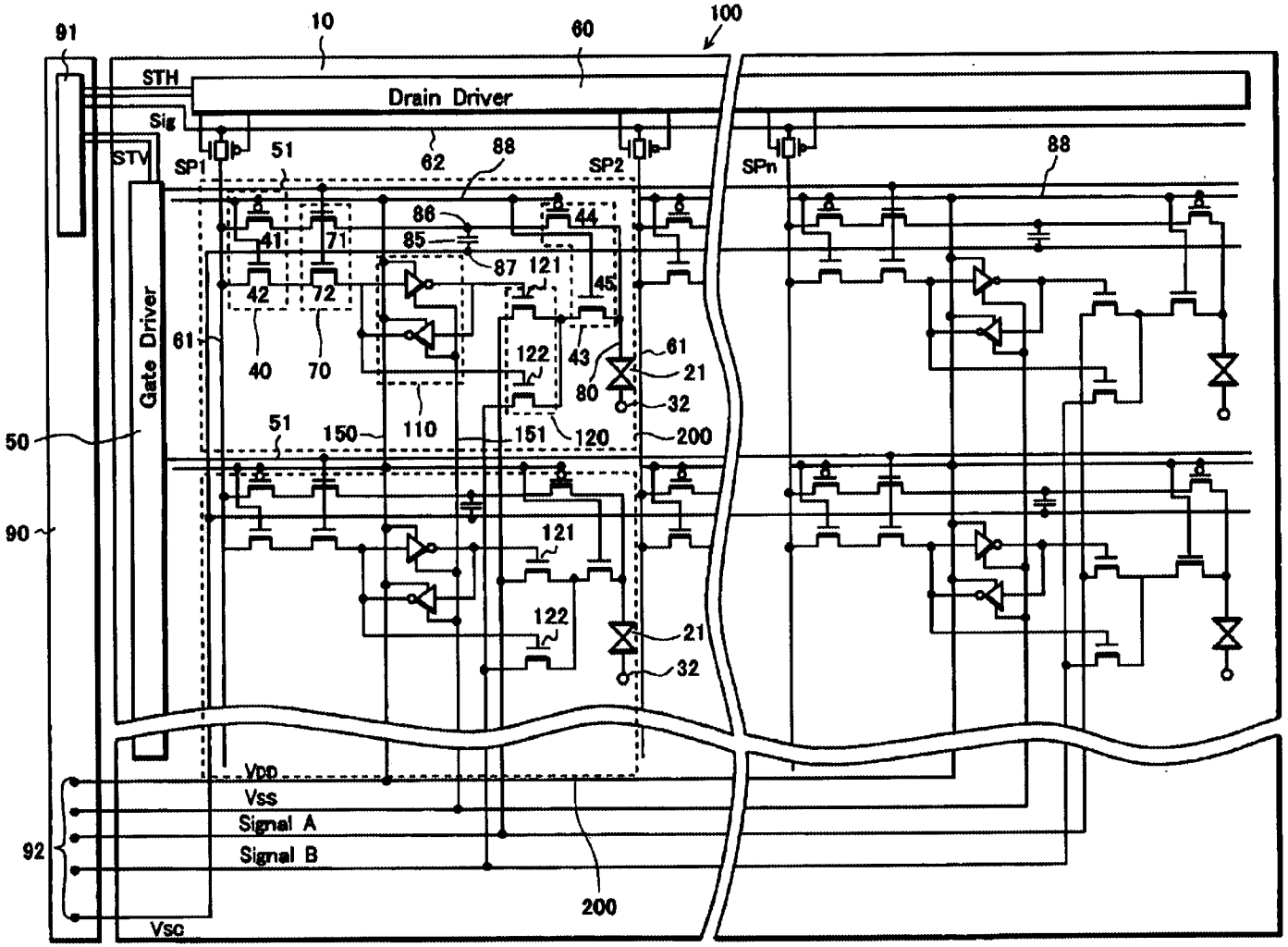
FIG. 3 is a circuit diagram of a liquid crystal display device of the first embodiment of this invention.

FIG. 3 is a circuit diagram of a liquid crystal display device of the first embodiment of this invention. The liquid crystal display device shown in FIG. 1 has an independent wiring for each of the high voltage power line 150 which supplies high voltage Vdd, the low voltage power line 151 which supplies low voltage Vss to the retaining circuit, and the circuit selection signal line 88 provided for the circuit selection circuits 40, 43. Thus, in the area occupied by these lines, the integration of the pixel element 200 is limited to a certain degree.

Thus, as shown in FIG. 3, the circuit selection signal line 88 is cut off from the source of the signal and connected to the high voltage power line 150 of the retaining circuit 110. That is, the high voltage power line 150 of the retaining circuit 110 is extended toward and connected to the circuit selection signal line 88. The part of the circuit selection signal line 88 adjacent to the gate driver 50 is eliminated. And the circuit selection signal line 88 between the pixel elements 200 adjacent to each other can also be cut off.

That is, the high voltage power line 150 also performs as the circuit selection signal line 88. By this, one of the signal lines can be omitted and this can also omit the connection of the circuit selection signal line 88 between the pixel elements 200 adjacent to each other. Thus, the integration of the pixel element 200 is improved.

When the voltage of the high voltage power line 150 (circuit selection signal line 88) is at L (Vss level), the TFTs 41, 44 (P-channel TFT) of the circuit selection circuits 40, 43 are on and TFTs 42, 45 (N-channel TFT) are off, so that the first display circuit is selected. Then, the analog display mode is selected accordingly. In this case, as it is not necessary for the retaining circuit to be operable, there is no problem if the voltage of the high voltage power line 150 is at L.

On the other hand, when the voltage of the high voltage power line 150 (circuit selection signal line 88) is at H (Vdd level), the TFTs 41, 44 of the circuit selection circuits 40, 43 are off and TFTs 42, 45 are on, so that the second display circuit is selected. Then, the digital display mode is selected accordingly. The retaining circuit 110 is provided with the high voltage Vdd through the high voltage power line 150 and becomes operable.

Figure 4:
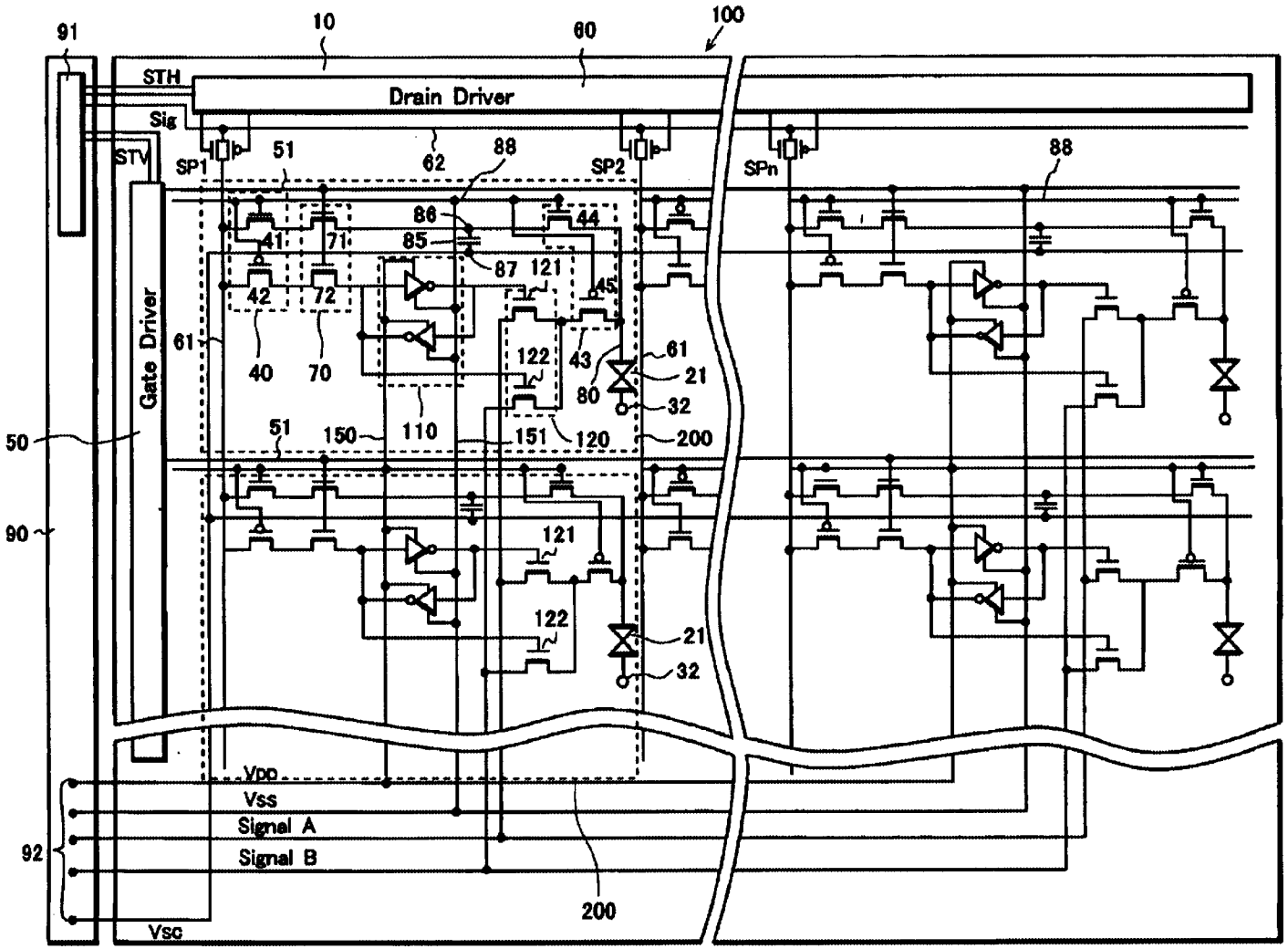
FIG. 4 is another circuit diagram of a liquid crystal display device of the first embodiment of this invention.

In the circuit diagram described above, the high voltage power line 150 also performs as the circuit selection signal line 88. But, as shown in FIG. 4, the low voltage power line 151 can also be used as the circuit selection signal line 88. In this case, the circuit selection signal line 88 is cut off from the source of the signal and connected to the low voltage power line 151 of the retaining circuit 110. The channel polarity of the TFTs 41, 42, 44, 45 of the circuit selection circuits 40, 43 is reversed. That is, the TFTs 41, 44 become N-channel and the TFTs 42, 45 become P-channel respectively.

When the voltage of the low voltage power line 151 (circuit selection signal line 88) is at H, the TFTs 41, 44 of the circuit selection circuits 40, 43 are on and the first display circuit is selected. By this, the analog display mode is selected. In this case, as it is not necessary for the retaining circuit to be operable, there is no problem if the voltage of the high voltage power line 151 is at H.

On the other hand, when the voltage of the low voltage power line 151 (circuit selection signal line 88) is at L (Vss level), the TFTs 41, 44 of the circuit selection circuits 40, 43 are off and TFTs 42, 45 are on, so that the second display circuit is selected. Then, the digital display mode is selected accordingly. The retaining circuit 110 is provided with the high voltage Vdd and the low voltage Vss through the high voltage power line 150 and the low voltage power line 151 respectively, and the retaining circuit 110 becomes operable.

Figure 5:
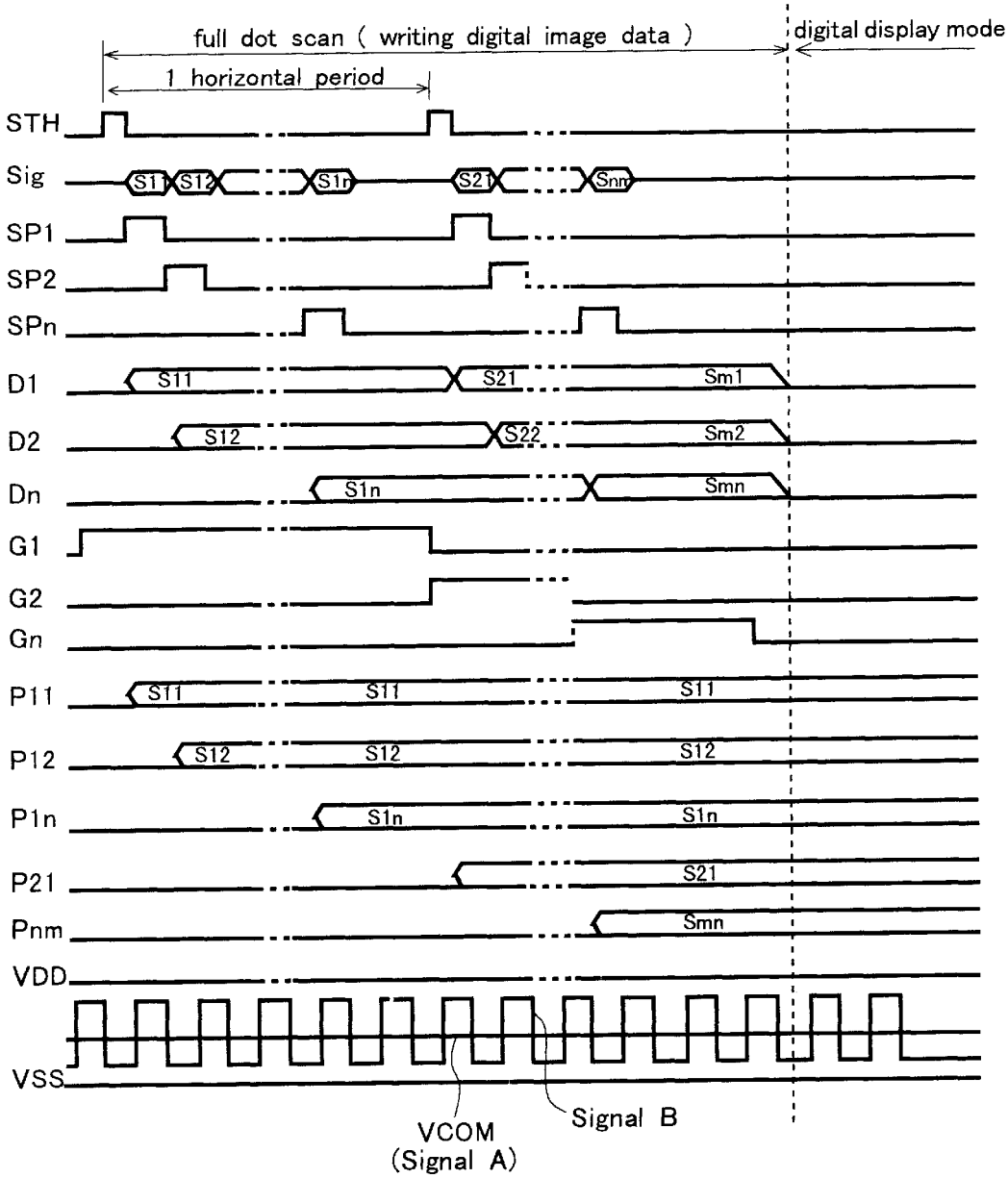
FIG. 5 is a timing chart of the liquid crystal display device of the first embodiment of this invention.

A driving method of the display device having the configuration above will be described below in reference to FIGS. 2, 3 and 5. FIG. 5 shows a timing chart when the liquid crystal display device is set to operate under the digital display mode. Here, the operation of the display device will be explained when the high voltage power line 150 also works as the circuit selection signal line 88.

(1) Analog Display Mode

The analog display mode is selected in response to the display mode selection signal MD. Then, the analog image signal is fed to the data line 62, and the voltage applied to the high voltage power line 150, which is also used as the circuit selection signal line 88, changes to L so that the TFTs 41, 44 of the circuit selection circuits 40, 43 turn on.

The sampling transistor SP turns on in response to the sampling signal based on the horizontal start signal STH so that the analog image signal is provided to the drain signal line 61 through the data signal line 62.

The scanning signal is provided to the gate signal line 51 in accordance with the vertical start signal STV. When the TFT 71 turns on in response to the scanning signal, the analog image signal Sig is applied, through the drain signal line 61, to the pixel electrode 80 and the storage capacitor element 85, which holds the applied voltage. The liquid crystal 21 aligns itself in accordance with the image signal voltage applied to the liquid crystal 21, resulting in a display image.

This analog display mode is suitable for showing a full-color moving image because the image signal voltage is successively inputted. However, the external LSI 91 on the circuit board 90, and drivers 50, 60 continuously consume the electric power for driving the liquid crystal display device.

(2) Digital Display Mode

When the digital display mode is selected in response to the display mode selection signal MD, the data signal line 62 is set to receive the digital image signal. At the same time, the voltage of the high voltage power line 150, which is also used as the circuit selection signal line 88, turns to H, and the retaining circuit 110 is set to be operable. Further, the TFTs 41, 44 of the circuit selection circuits 40, 43 turn off and the TFTs 42, 45 turn on.

The panel drive LSI 91 on the external circuit board 90 sends the start signal STV and STH to the gate driver 50 and the drain driver 60, respectively. In response to the start signal, sampling signals are sequentially generated and turn on the respective sampling transistors SP1, SP2, . . . , SPn sequentially, which sample the digital image signal Sig and send it to each of the drain signal lines 61.

Now, the operation of the first row of the matrix, or the portion of the circuit connected to the gate signal line 51, which receives the scanning signal G1, will be described below. First, the scanning signal G1 turns on each TFT of the pixel elements (P11, P12, . . . , P1*n*) connected to the gate signal line 51, for one horizontal scanning period.

In the pixel element P11 located at the upper left corner of the matrix, the sampling transistor SP1 takes in the digital signal S11 and feeds it to the drain signal line 61. The TFT 72 turns on in response to the scanning signal G1, and the drain signal D1 is inputted to the retaining circuit 110.

The signal retained by the retaining circuit 110 is then fed to the signal selection circuit 120, and is used by the signal selection circuit 120 to select one of the signal A and signal B. The selected signal is then applied to the liquid crystal 21 through the pixel electrode 80.

Thus, after a completion of a scanning from the first gate signal line 51 on the top row of the matrix to the last gate signal line 51 on the bottom row of the matrix, a full display frame scan (one field scan), or a full dot scanning, is completed and the display device shows an image.

When the display device shows an image, the voltages supplied to the gate driver 50, the drain driver 60 and the external panel drive LSI 91 are stopped for halting the drive. The voltages Vdd, Vss are always supplied to the retaining circuit 110 for driving. Also, the common electrode voltage is supplied to the common electrode 32 and each of the signals A and B is supplied to the selection circuit 120.

When the voltages Vdd, Vss are supplied to the retaining circuit 110, the common electrode voltage Vcom (signal A) is applied to the common electrode 32, and the liquid crystal display panel 100 is in a normally-white (NW) mode, the signal A receives the same voltage as the common electrode 32 and the signal B receives the AC drive voltage (for example, of 60 Hz) for driving the liquid crystal. By this, it is possible to hold the data and display one still image. Here, the voltage is not applied to the gate driver 50, drain driver 60 and external LSI 91.

When the retaining circuit 110 receives the digital image signal of H through the drain signal line 61, the first TFT 121 of the signal selection circuit 120 receives a L signal and accordingly turns off, and the second TFT 122 receives a H signal and turns on.

In this case, the signal B is selected and the liquid crystal 21 receives the signal B having a phase opposite to the signal A applied to the common electrode 32, resulting in the rearrangement of the liquid crystal 21. Since the display panel is in a NW mode, a black image results.

When the retaining circuit 110 receives the digital image signal of L through the drain signal line 61, the first TFT 121 of the signal selection circuit 120 receives a H signal and accordingly turns on, and the second TFT 122 receives a L signal and turns off. In this case, the signal A is selected and the liquid crystal 21 receives the signal A, which is the same as the signal A applied to the common electrode 32. As a result, there is no change in the arrangement of the liquid crystal 21 and the pixel element stays white.

In this way, by writing and holding the data for one image display, it is possible to display the data as a still image. In this case, each of the drivers 50, 60 and the LSI 91 stop their drive resulting in the reduction of the electric power consumption.

As described above, the embodiment of this invention is capable of corresponding to the two kinds of display, a full color moving picture display (analog display mode), for which data is successively fed, and a digital depth display (digital display mode) of low energy consumption within single liquid crystal display panel 100. Also, one of the high and low voltage power lines 150 and 151 performs as the circuit selection signal line 88, resulting in the reduction of one signal line. Thus, the high-density integration of the pixel element can be achieved.

Figure 6:
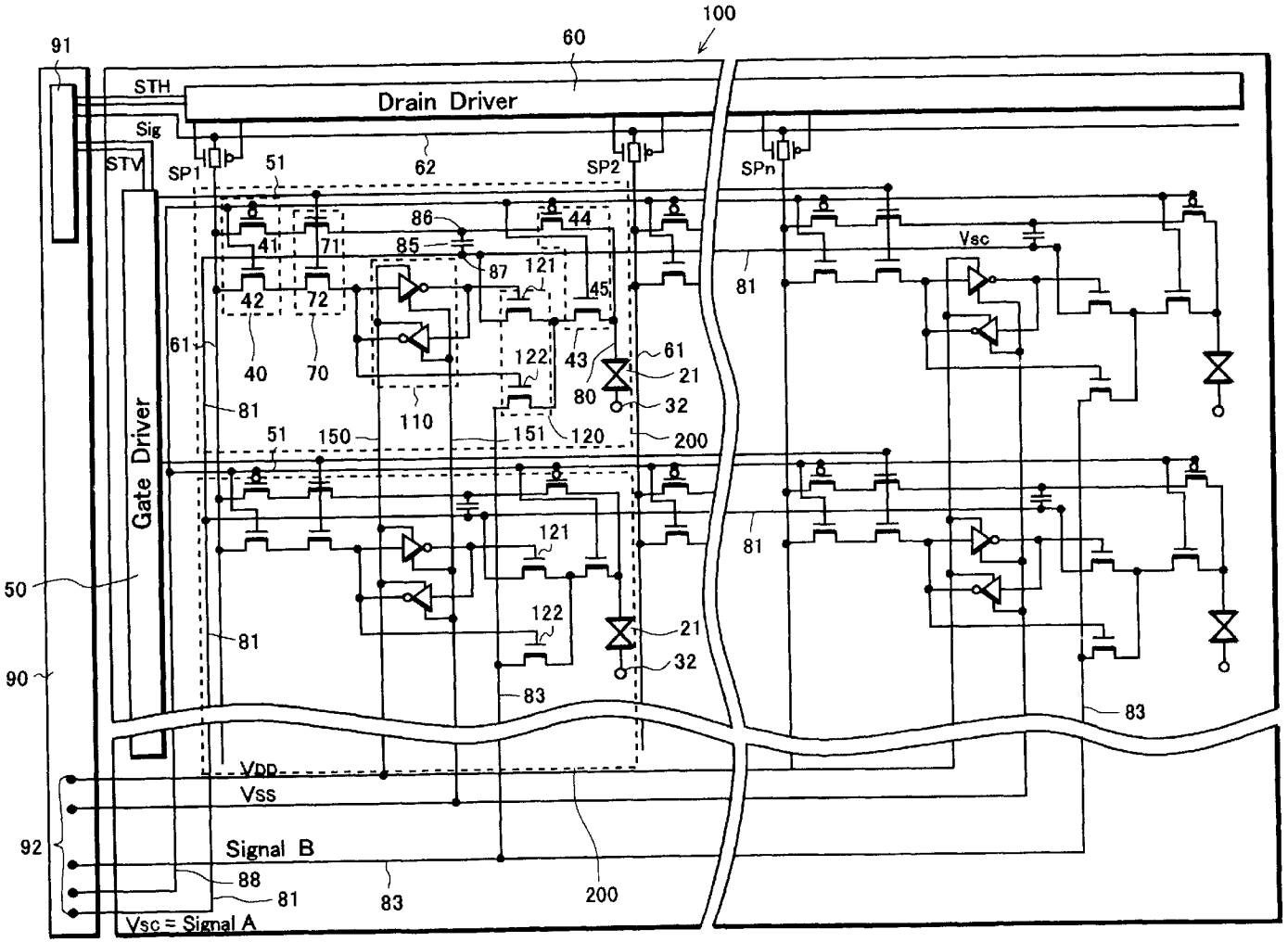
FIG. 6 is a circuit diagram of a liquid crystal display device of the second embodiment of this invention.
Figure 7:
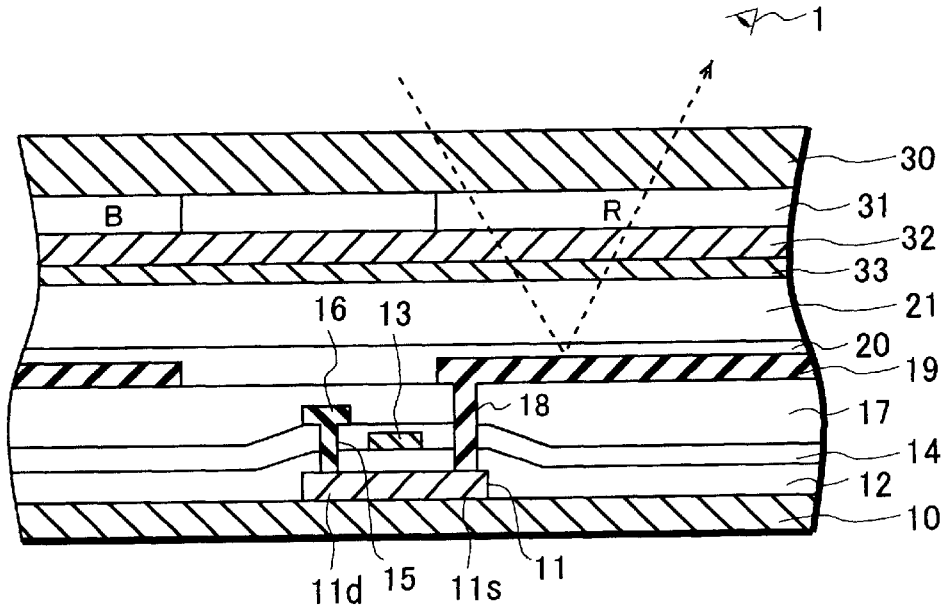
FIG. 7 is a cross-sectional view of a reflection type liquid crystal display device.
Figure 8:
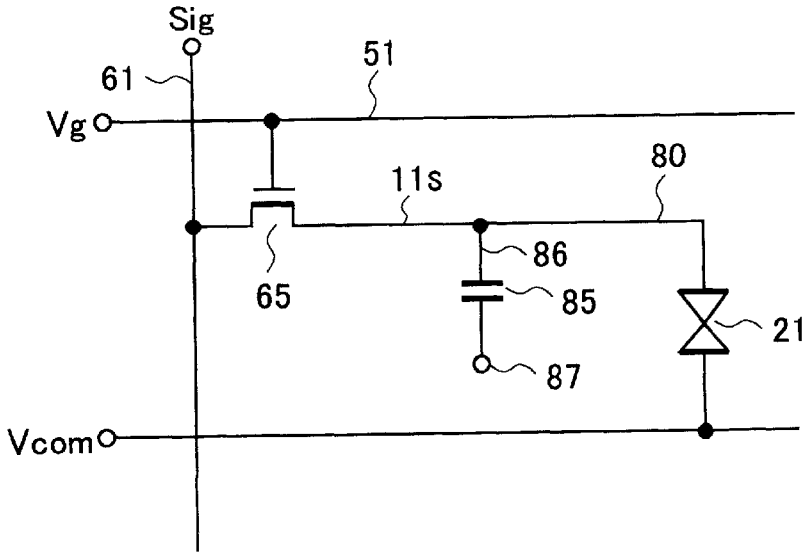
FIG.8 PRIOR ART
FIG. 8 is a circuit diagram of a conventional liquid crystal display device.
Figure 9:
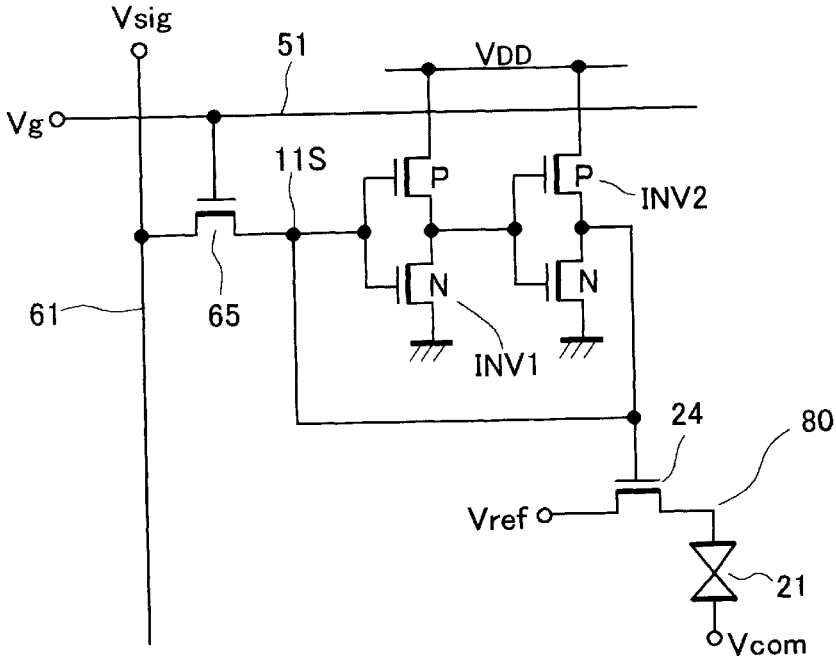
FIG.9 PRIOR ART
FIG. 9 is another circuit diagram of a conventional liquid crystal display device.

FIG. 6 is a circuit diagram of a liquid crystal display device of the second embodiment of this invention. In the display device shown in FIG. 1, the signal A and signal B for displaying white and black are fed from the signal selection circuit 120 through signal lines 82, 83 respectively. The storage capacitor line 81 is independent from these signal lines 82, 83, resulting in the large wiring space. Thus, it is difficult to reduce the size of the pixel element.

As a countermeasure, the bias voltage Vsc fed through the storage capacitor line 81 is also used as the signal A in this invention. As described above, the common electrode signal Vcom supplied to the common electrode 32 of the liquid crystal 21 is the same signal as signal A. That is, Vsc=signal A=common electrode signal Vcom.

The storage capacitor line 81 is connected to each of the pixel elements 200, within which the storage capacitor line 81 is ramified, extends to the location of the signal selection circuit 120, and is connected to the drain of the TFT 121 of the signal selection circuit. That is, the storage capacitor line 81 can also be used as the signal line 82 for supplying the signal A. This can eliminate the signal line 82 supplying the signal A shown in FIG. 1. Since one of the signal lines can be omitted, the space for wiring becomes smaller and the size of the pixel element can be reduced.

The driving method of this embodiment is the same as that of the first embodiment of this invention. That is, as in the first embodiment, the signal held by the retaining circuit 110 is inputted to the signal selection circuit 120, which then selects signal A or B, and the selected signal is applied to the pixel element 80, the voltage of which is applied to the liquid crystal 21. However, in this embodiment, the bias voltage Vsc of the storage capacitor element 85, which is equal to the signal A is fed through the storage capacitor line 81 (Vsc=signal A). The voltages Vdd, Vss are always supplied to the retaining circuit 110 for driving and the common electrode 32 is provided with the common electrode voltage. Also, each of the signals A and B is supplied to the selection circuit 120. When the common electrode voltage Vcom is applied to the common electrode 32 and the liquid crystal panel 100 is in a normally-white mode, the signal A receives the same voltage as the common electrode 32 and the signal B receives the AC drive voltage ( for example, of 60 Hz) for driving the liquid crystal. This is performed in the same manner as the first embodiment. However, the signal A is fed through the storage capacitor line 81 (signal A=Vsc=Vcom) in this embodiment.

It is preferable that the display device of this invention be applied to a liquid crystal display, especially to a reflection-type liquid crystal display device. A device structure of a reflection-type liquid crystal display device will be described below in reference to FIG. 6.

In FIG. 6, the element denoted by the reference numeral 10 is an insulating substrate on one side of the display device, and the element denoted by the reference numeral 11 is an isolated polysilicon semiconductor layer 11 on the substrate 10. A gate insulating film 12 is formed on top of the polysilicon semiconductor layer 11, and a gate electrode 13 is formed on the portion of the insulating film 12 corresponding to the polysilicon semiconductor layer 11.

A source 11*s* and a drain 11*d* are formed in the semiconductor layer 11 at the portions located at both sides of the gate electrode 13. An interlayer insulating film 14 is deposited above the gate electrode 13 and the gate insulating layer 12. Contact holes 15 and 18 are formed at the portions of the interlayer insulating film 14 corresponding to the drain 11*d* and the source 11*s*. The drain 11*d* is connected to a drain electrode 16 through the contact hole 15, and the source 11*s* is connected to a pixel electrode 19 also through the contact hole 18 piercing through the interlayer insulating film 17 formed on the interlayer insulating film 14.

The pixel electrode 19 is formed on the flattening insulating film 17 and is made of a reflecting electrode material, for example, aluminum (Al). An orientation film 20 is formed on the pixel electrode 19 and the portions of the flattening insulating film 17 not covered by the pixel electrode 19. The orientation film 20 is made of polyimid and aligns the liquid crystal 21.

The insulating substrate 30 on the other side of the display device has color filter 31 for generating red (R), green (G), and blue (B) colors, a common electrode 32 made of a transparent electrode material such as ITO (indium tin oxide), and an orientation film 33 for aligning the liquid crystal 21. When the image is not shown in color display, the color filter 31 is not necessary.

The liquid crystal 21 fills the gap between the two insulating substrates 10, 30, which are attached together by sealing the peripheral portions of the two insulating substrates with a sealing adhesive such that there is a predetermined space for the liquid crystal 21 between them.

As shown in the figure, the light coming from an observer 1 side through the common electrode 32 and incident on the pixel electrode 19 is reflected by the pixel electrode 19 so that the observer 1 recognizes the light modulated by the liquid crystal 21 of the display device.

In this configuration, the display device utilizes the lights external to the device and does not need an internal light source such as the one known as a back light in the transmitting-type liquid crystal display. By applying the display device of this invention to the reflection-type liquid crystal display device, it is possible to further reduce the consumption of the electric power since there is no need for the internal light source consuming the electric power in the reflection-type display device.

In the embodiment described above, the voltage to the common electrode and the signals A and B are applied to the respective terminals throughout one full dot scan period of a field. The display device of this invention is not limited to that embodiment, and includes a configuration in which those voltages are not applied throughout the scan. Such a configuration is preferable because of a further reduction of the consumption of the electric power by the display device.

Furthermore, in the above embodiment, one bit digital data signal is used in the digital display mode. The display device of this invention is not limited to that embodiment, and is also applied to a multiple bit digital data signal system in which a multiple level image representation is possible. In this configuration, the retaining circuits and the signal selection circuits are provided in accordance with the number of the bits used in the system.

Furthermore, in the above embodiment, only a portion of the liquid crystal display panel is used for displaying the still image. The display device of this invention is not limited to that embodiment, and the still image may be displayed in the entire area of the display panel.

Still furthermore, in the above embodiment, the reflection-type liquid crystal display device is used. The display device of this invention is not limited to that embodiment, and is applied to the transmitting-type liquid crystal display device as well. In that case, it is possible to reduce the parasitic capacity while maintaining the original transmittance, if transparent electrode is applied to the area except the portions for the TFT, retaining circuit, signal selection circuit, and signal wiring within one pixel element. Even if this invention is applied to the transmitting-type liquid crystal display device, it is also possible to reduce the consumption of the electric power by stopping supplying the voltage to the gate driver 50, drain driver 60 and external panel drive LSI 91 after displaying one screen.

According to this invention, a single display panel provides two different display modes, the analog display mode for a full color moving image and the digital display mode for reducing the electric power consumption. Also, one of the high and low voltage power lines of the retaining circuit performs as the circuit selection signal line for selecting the display mode. Thus, the high-density integration of the display device is possible. Additionally, one of the first and second signal lines performs as the storage capacitor line for biasing an electrode of the storage capacitor element. Thus, one of the signal lines can be omitted and the size reduction of the pixel element can be achieved.

This invention enables the considerable reduction of the electric power consumption of the display device as a whole especially when the digital display mode is selected. Thus, if the display device of this invention is applied to portable TV or cellular phone which has only a limited electric power source such as battery, the image can be displayed for considerably long time.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not construed to narrow the full scope of protection to which the invention is entitled.

What is claimed is:

1. A display device comprising:

a plurality of gate signal lines disposed in a predetermined direction on a substrate;

a plurality of drain signal lines disposed in a direction different from the predetermined direction;

a plurality of pixel elements which are disposed as a matrix, activated by a scanning signal fed through the gate signal line and provided with an image signal fed through the drain signal line;

a pixel electrode provided within the pixel elements;

a first display circuit which is disposed for the pixel elements and provides the pixel elements with the image signals;

a second display circuit which is disposed for the pixel elements, include a retaining circuit holding the image signal and provides the pixel electrode with an voltage corresponding to the image signal retained by the retaining circuit; and a circuit selection circuit for selecting one of the first and second display circuit in response to a circuit selection signal disposed for the pixel elements;

wherein the circuit selection signal is supplied to the circuit selection circuit through an electric power line which is used for supplying a power voltage to the retaining circuit.

2. The display device of claim 1, wherein the retaining circuit comprises two inverter circuits which are positively fed back to each other, said inverter circuits being provided with a high voltage power line and a low voltage power line, said high voltage power line being used for supplying the circuit selection signal to the circuit selection circuit.

3. The display device of claim 2, wherein the circuit selection circuit comprises a first switching element for selecting the first display circuit and a second switching circuit for selecting the second display circuit, said first and second switching elements complimentarily performing a switching operation in response to the circuit selection signal supplied through the high voltage power line.

4. The display device of claim 3, wherein the first switching element comprises a thin film transistor of a first channel type, and the second switching element comprises a thin film transistor of a second channel type.

5. The display device of claim 1, wherein the retaining circuit comprises two inverter circuits which are positively fed back to each other, said inverter circuits being provided with a high voltage power line and a low voltage power line, said low voltage power line being used for supplying the power voltage to the retaining circuit.

6. The display device of claim 5, wherein the circuit selection circuit comprises a first switching element for selecting the first display circuit and a second switching circuit for selecting the second display circuit, said first and second switching elements complimentarily performing a switching operation in response to the circuit selection signal supplied through the low voltage power line.

7. The display device of claim 6, wherein the first switching element comprises a thin film transistor of a first channel type, and the second switching element comprises a thin film transistor of a second channel type.

8. A display device, comprising:

a plurality of gate signal lines disposed in a predetermined direction on a substrate;

a plurality of drain signal lines disposed in a direction different from the predetermined direction;

a plurality of pixel elements which are disposed as a matrix, activated by a scanning signal fed through the gate signal line and provided with an image signal fed through the drain signal line;

a first display circuit which has a storage capacitor element for holding an analog image signal fed through the drain signal line in response to a signal fed through the gate signal line and supplies the signal held by the storage capacitor element to a pixel electrode;

a second display circuit which is disposed near the first display circuit, includes a retaining circuit holding a digital image signal fed through the drain signal line in response to the signal fed through the gate signal line and a signal selection circuit for selecting one of the signals fed through a first and second signal lines for supplying said one of the signals to the pixel electrode; and, a circuit selection circuit for selecting one of the first and second display circuit in response to a circuit selection signal;

wherein one of the first and second signal lines works as a storage capacitor line for biasing an electrode of the storage capacitor element.

9. The display device of claim 8, wherein the signal supplied to the storage capacitor line is the same as the signal supplied to a common electrode working in accordance with the pixel electrode.

* * * * *